US012071826B2

(12) United States Patent
Løken

(10) Patent No.: US 12,071,826 B2
(45) Date of Patent: Aug. 27, 2024

(54) APPARATUS AND METHOD FOR TUBING HANGER INSTALLATION

(71) Applicant: CCB Subsea AS, Ågotnes (NO)

(72) Inventor: Helge Løken, Mathopen (NO)

(73) Assignee: CCB Subsea AS, Ågotnes (NO)

( * ) Notice: Subject to any disclaimer, the term of this patent is extended or adjusted under 35 U.S.C. 154(b) by 1 day.

(21) Appl. No.: 18/246,614

(22) PCT Filed: Oct. 18, 2021

(86) PCT No.: PCT/NO2021/050215
§ 371 (c)(1),
(2) Date: Mar. 24, 2023

(87) PCT Pub. No.: WO2022/093033
PCT Pub. Date: May 5, 2022

(65) Prior Publication Data

US 2023/0399913 A1 Dec. 14, 2023

(30) Foreign Application Priority Data

Oct. 30, 2020 (NO) ..... 20201191

(51) Int. Cl.
*E21B 33/035* (2006.01)
*E21B 33/043* (2006.01)

(52) U.S. Cl.
CPC ..... *E21B 33/035* (2013.01); *E21B 33/043* (2013.01)

(58) Field of Classification Search
CPC .... E21B 33/035; E21B 33/043; E21B 23/042; E21B 23/0418
See application file for complete search history.

(56) References Cited

U.S. PATENT DOCUMENTS 5,145,006 A 9/1992 June
5,372,201 A 12/1994 Milberger
2004/0238175 A1 12/2004 Wade et al.
(Continued)

FOREIGN PATENT DOCUMENTS

BR PI0600217 A * 2/2006 ..... E21B 33/035
EP 1336721 8/2003
(Continued)

OTHER PUBLICATIONS

Norwegian Search Report for No. 20201191, dated May 11, 2021.
International Search Report and the Written Opinion for PCT/NO2020/050215, dated Jan. 13, 2022.

*Primary Examiner* — James G Sayre
(74) *Attorney, Agent, or Firm* — Andrus Intellectual Property Law, LLP

(57) ABSTRACT

A method for operating an apparatus for installing a tubing hanger in a subsea wellhead or X-mas tree without hydraulic cables from the surface and without valves for controlling hydraulic functions. The method includes: providing an apparatus for installing the tubing hanger; preparing the apparatus for installation; actuating the tubing hanger's locking function via pressurized completion fluid that causes direct actuation of ring pistons that are arranged to operate the locking sleeve and the locking segments of the tubing hanger; verifying the tubing hanger is locked; and releasing the apparatus mechanically or hydraulically from the installed tubing hanger.

8 Claims, 9 Drawing Sheets

(56) References Cited

U.S. PATENT DOCUMENTS

| | | | | |
|---|---|---|---|---|
| 2004/0251031 | A1 | 12/2004 | Reimert | |
| 2005/0217845 | A1 | 10/2005 | McGuire | |
| 2011/0247798 | A1* | 10/2011 | June | E21B 33/043 166/208 |
| 2011/0247799 | A1 | 10/2011 | June et al. | |
| 2013/0175045 | A1 | 7/2013 | Rytlewski et al. | |
| 2014/0166298 | A1* | 6/2014 | Fenwick | E21B 33/04 166/360 |
| 2017/0191324 | A1 | 7/2017 | Nguyen | |
| 2018/0179838 | A1* | 6/2018 | Nguyen | E21B 33/04 |
| 2018/0258727 | A1* | 9/2018 | Lim | E21B 33/0422 |
| 2021/0062604 | A1* | 3/2021 | Monjure | E21B 33/0415 |
| 2021/0324698 | A1* | 10/2021 | Kardec | E21B 33/043 |

FOREIGN PATENT DOCUMENTS

| | | | | |
|---|---|---|---|---|
| GB | 2448262 | | 10/2008 | |
| WO | 2019004842 | | 1/2019 | |
| WO | WO-2022177444 | A1 * | 8/2022 | E21B 23/01 |

* cited by examiner

APPARATUS AND METHOD FOR TUBING HANGER INSTALLATION

CROSS-REFERENCE TO RELATED APPLICATIONS

This application is the U.S. national stage application of International Application PCT/NO2021/050215, filed Oct. 18, 2021, which international application was published on May 5, 2022, as International Publication WO 2022/093033 in the English language. The International Application claims priority of Norwegian Patent Application No. 20201191, filed Oct. 30, 2020. The international application and Norwegian application are both incorporated herein by reference, in entirety.

FIELD

This invention concerns a device and a method for installing a production tubing and an associated tubing hanger (TH) in a subsea wellhead or a subsea horizontal X-mas tree.

More specifically it concerns a tool that should be operable without the use of hydraulic cables from the surface and without the need for hydraulic valves for controlling the functions. The invention concerns a method for operating the tool: coupling it to a tubing hanger before installation, locking a tubing hanger in a subsea wellhead or X-mas tree, verifying locking and disconnecting the tool from a locked tubing hanger.

BACKGROUND

Traditionally, subsea tools for well completion have been hydraulically operated from the surface via hydraulic cables in a twisted hose bundle with an external, reinforced jacket, also called hydraulic umbilicals, which are clamped to a work string. The work string, which can consist of connected drill pipes or riser joints, will typically vary between an inner diameter of 75 mm (3") and 180 mm (7"). The dimension of the umbilical typically varies between an outer diameter of 70 and 100 mm.

In the well completion phase, the drilled well is provided with a production tubing that is in a stepwise manner made up of pipe joints and lowered down into the well. The equipment is lowered down through a marine riser that is hanging from a drilling vessel and is coupled to a subsea blowout preventer (BOP) on the seabed. The BOP can be locked to a wellhead or X-mas tree that is locked to a wellhead. The marine riser, typically with an outer diameter of 535 mm (21"), projects up from a lower marine riser package (LMRP) on the BOP to the underside of the drill deck of the vessel, and is filled with drilling or completion fluid that is in connection with the well.

The upper end of the production tubing and hydraulic lines for controlling a downhole valve are coupled to the underside of a tubing hanger, which at its upper end is coupled to a tubing hanger running tool (THRT).

It is currently common to use a simplified landing string when installing a tubing hanger. In this case, the work string will consist of drill pipe joints. The work string can also be a work-over riser if the tubing hanger running tool forms a lower part of a complete landing string, which in addition to a slick-joint with inner bores and a pipe joint that can be sheared with the BOP's shear ram, is an assembly of well barrier valves. This tool system can be used if the well is to be flowed to a test separator aboard the drilling vessel in connection with cleaning of the well after perforation of the production tubing in the well.

The simplified landing string typically consists of a drill pipe joint adapted to the BOP, various hydraulic pipes and a slick-joint with inner bores for coupling hydraulic pipes to the tubing hanger running tool at the lower end and pipe connections for coupling an umbilical at the upper end. The umbilical is clamped to the work string as the equipment is lowered down through the riser. Finally, the tubing hanger is rotated into landing position by means of orientation grooves before it is landed and locked in a locking groove in the wellhead or in a X-mas tree. The simplified landing string is arranged so that the transition pipe is placed directly above one of the BOP's pipe rams, which can be made to clamp about it in a sealing manner.

For tool systems and well equipment being operated at depths down to 500 m, direct hydraulic actuation from the surface is commonly used, which is controlled with directional control valves with hydraulic fluid being supplied from the control system's hydraulic power unit (HPU). Hydraulic outlets from the control system are connected to the tool system through surface distribution and umbilical systems.

Subsea control modules with directional control valves for actuating functions have been developed for deep waters and operation of tool systems with many functions. The control module is installed on the top side of the tool system. This reduces response time and how many hydraulic umbilical lines are needed.

The umbilical and the associated clamps for the work string are exposed to damage inside the marine riser in that they can be squeezed between the work string and the inside of the marine riser when the vessel and the marine riser move due to external environmental loads like waves and ocean currents. Potential damages to the umbilical and the consequences of loose parts from damaged clips falling down through the riser to the BOP, constitute a significant risk of lost productive rig time. Great water depths will make the problems and the financial consequences of such events worse.

Due to said and other disadvantages of clamping the umbilical to the work string and the advantages a tool system without an umbilical will have;—increased efficiency, lesser damage potential for the completion string and personnel, lower equipment costs etc.—an alternative solution has been developed that will be operable without hydraulic directional control valves and an umbilical from the surface.

Prior art for landing strings shows them being provided with a secondary system for operating emergency functions. The system consists of a module with hydraulic shuttle valves that are normally open for actuating tool functions via the primary hydraulic system, but in an emergency can switch to operating selected tool functions with completion fluid. Burst disks that form part of the secondary system burst in a predetermined sequence as the pressure is pumped up in a closed annulus in the BOP that surrounds the valve module. The annulus is pressurized from the surface via existing pipe connections, so-called choke and kill lines, that are otherwise used actively in well control situations. Pressurized completion fluid penetrates through the ports with the burst disks and activates selected functions via the shuttle valves in the valve module.

From patent literature the following is cited as background art:

US2005217845A1 describes a solution where completion fluid is pressurized in a closed annulus in a BOP through kill/choke lines to the surface. Pressurized completion fluid is distributed as hydraulic supply to a subsea control module. The control module is provided with electrically activated directional control valves that via communication from the surface are commanded to pressurize hydraulic outlets of control lines that distribute fluid for actuating the tool functions of a lower landing string assembly (LLSA) and the associated tubing hanger running tool/tubing hanger. The tool system can thereby be of a standard type, i.e. hydraulically operated, corresponding to that which is operated from the surface via an umbilical. One difference is that completion fluid is used instead of pure hydraulic fluid, with the challenges that this entails.

US2013175045A1 describes a closed hydraulic system with accumulators that supply hydraulic fluid to directional control valves in a control module. The pressure in the hydraulic system can be recharged when the supply pressure becomes too low to carry out further tool operations. At least one hydraulic piston pump charges the hydraulic accumulators. The pump is driven by pressurized completion fluid from a closed annulus in a BOP connected to the surface via kill/choke lines.

WO2019004842A1 describes a solution where a bladder functioning as a hydraulic reservoir is disposed in a closed annulus in a BOP. The annulus is connected to the surface via kill/choke lines. When the annulus is pressurized, the bladder is squeezed and supplies hydraulic fluid to a control module with directional control valves to actuate tool functions.

US2011/0247799A1 describes a method for installing a production tubing and a tubing hanger in a subsea wellhead or X-mas tree wherein the apparatus comprises an upper transition pipe coupled to a work string, a lower centre element with a through-going centre passage and several hydraulic channels, a housing that surrounds the upper part of the centre element, an expandable locking ring for locking the centre element to an internal groove in the tubing hanger, a ring piston that surrounds the central part of the centre element and is arranged to expand the locking ring, and locking balls or gripping fingers that can engage with the locking sleeve when they are being radially displaced. Shearable locking pins arranged for locking movable components that surround the centre element are not described. Also not described herein is a housing that surrounds the lower part of the centre element and that is provided with threads that can engage with external threads on the centre element.

SUMMARY

The purpose of the invention is to eliminate the need for an umbilical from the surface for hydraulic supply and control of tool functions in subsea well completion, as well as the need for controlled directional control valves for hydraulic actuation of the tool functions.

The purpose is fulfilled by features specified in the description below and subsequent patent claims.

According to a first aspect of the invention, a tubing hanger running tool provided with hydraulic function pistons for operating functions by means of pressurized completion fluid is provided, as well as devices for mechanically releasing the apparatus from a locked tubing hanger.

According to a second aspect of the invention, a method is provided for installing a tubing hanger in a wellhead or X-mas tree using the tubing hanger running tool according to the first aspect of the invention on the surface, and pressurising ring piston functions by means of surrounding completion fluid in isolated annuli in a BOP for actuating tool functions in connection with locking the tubing hanger in the wellhead or the X-mas tree.

The method may comprise verifying locking of a tubing hanger by registering a pressure drop in the annulus via channels in the tubing hanger running tool that open to the top side of the isolated annulus after the ring pistons have completed their stroke and the tubing hanger is locked.

The method may also comprise releasing the tubing hanger running tool from a locked tubing hanger. Rotation of the work string from the surface results in devices in the apparatus being screwed out of locked engagement with the tubing hanger.

Also provided are alternative methods for releasing the tubing hanger running tool from the locked tubing hanger. A ring piston that keeps the apparatus locked to the tubing hanger via a locking ring, is pushed back via pressurisation from the underside with a fluid from the surface supplied via the work string. The fluid flows through channels in an installed plug in the centre element of the apparatus and further through a side channel in the centre element with an outlet to the underside of the ring piston. Alternatively, the fluid is pressurized from a pressurized annulus in the BOP and distributed to the underside of the ring piston via a deep-hole bore in the tool.

In its first aspect, the invention more specifically concerns a tubing hanger running tool arranged for installing a production tubing with a tubing hanger in a subsea wellhead or in a subsea X-mas tree, characterised in that the tubing hanger running tool comprises:

- an upper transition pipe coupled to a work string;
- a middle slick-joint with a through-going, axial passage as well as channels for hydraulic functions;
- a lower centre element with a through-going, axial passage as well as channels for hydraulic functions;
- several sets of shearable locking pins that by spring-loading or manual displacement are arranged for locking movable parts that surround the centre element;
- an upper housing that surrounds an upper portion of the centre element and is provided with bores for hydraulic functions;
- a lower housing provided with anti-rotation elements and that surrounds a lower portion of the lower centre element and is provided with a threaded portion that is engaged with an external threaded portion on the lower centre element;
- an expandable locking ring arranged for locking the lower centre element to an internal groove in the tubing hanger;
- a first ring piston that surrounds the centre portion of the lower centre element and is arranged for stretching out the locking ring;
- at least one further ring piston that surrounds the upper housing, the at least one further ring piston being arranged to, when an upper piston area is pressurized with surrounding completion fluid, shear off at least one set of locking pins and axially displace a locking sleeve to an active position; and
- a set of locking balls or gripping fingers that when radially displaced are arranged to engage with an upper lip internally in the locking sleeve.

In its second aspect, the invention more specifically concerns a method for installing a tubing hanger in a wellhead or X-mas tree (9) using the tubing hanger running tool according to the first aspect of the invention, characterised in that before the tubing hanger is installed in the wellhead or the X-mas tree, the tubing hanger running tool is coupled to the tubing hanger through the following steps:

a) guiding the centre element with the lower housing into the tubing hanger with the anti-rotation elements in line with allocated locking grooves in the tubing hanger;
b) locking the centre element to the tubing hanger through hydraulic actuation of the first ring piston, and stretching out the locking ring to radial engagement with the internal groove in the tubing hanger, and allowing a first set of spring-loaded locking pins to couple the first ring piston to the upper housing;
c) gripping under an internal, upper lip on the locking sleeve of the tubing hanger either by activating the set of locking balls on the end of the second and the third ring piston, or activating the set of gripping fingers fastened on the lower edge of the fourth ring piston by allowing an external profile on the first ring piston to push the gripping fingers radially outwards, to thereby allow the first ring piston to stretch out the locking ring, and allow a further set of spring-loaded locking pins to couple the second ring piston to the third ring piston; and
d) securing the locking sleeve of the tubing hanger in the upper position by pressurising an annulus between the second ring piston and the upper housing or between the fourth ring piston and the upper housing, so that the locking sleeve of the tubing hanger is driven to the upper position where the second ring piston is secured to the upper housing by the set of locking pins.

The method may comprise these further steps for locking the tubing hanger to the wellhead or the X-mas tree:

e) closing a lower BOP pipe ram about the centre slick-joint so that a lower annulus filled with completion fluid is formed in the BOP;
f) pressurising the lower annulus via a choke line and letting the pressure act on the second, third and fourth ring piston so that the respective sets of locking pins are sheared off and said ring pistons are pushed down towards the locking sleeve of the tubing hanger;
g) letting said ring pistons carry with them the locking sleeve of the tubing hanger; and
h) letting the lower part of the locking sleeve of the tubing hanger be wedged in behind the locking segments of the tubing hanger so that the locking segments are pushed radially outwards in the locking grooves in the wellhead or X-mas tree.

The method may comprise these further steps for verifying locking of the tubing hanger to the wellhead or the X-mas tree:

i) allowing pressurized completion fluid in the annulus to flow in through corresponding, radial bores in the second, third or fourth ring piston, the upper housing and the centre element and further through an axial bore in the centre element and the slick-joint and out into the upper annulus on the top side of the lower BOP pipe ram; and
j) registering a pressure drop in the lower annulus from the surface via the choke line.

The method may comprise these further steps for pressure testing the tubing hanger after it has been installed in the wellhead or the X-mas tree:

k) opening the lower BOP pipe ram;
l) closing an upper BOP pipe ram in a sealing manner about the upper transition pipe; and
m) pressurising an annulus under the upper BOP pipe ram and verifying a stable pressure.

The method may comprise steps for disconnecting the tubing hanger running tool from the tubing hanger after the tubing hanger has been installed in the wellhead or X-mas tree:

r) installing a plug from the surface via the work string and landing it in a sealing manner against a seat in the through-going passage of the centre element;
s) pressurising a bore in the plug from the surface via the centre passages in the work string, the transition pipe and the slick-joint respectively;
t) allowing pressurized fluid to flow through a radial channel in the plug, further through a corresponding radial channel in the centre element and out on the underside of the first ring piston;
u) allowing the first ring piston to be displaced upwards by the pressure while fluid is evacuated from an annulus over the first ring piston so that the lower part of the first ring piston disengages from the locking ring;
v) letting the locking ring contract out of engagement with the locking groove on the inside of the tubing hanger; and
w) pulling the released tubing hanger running tool to the surface by means of the work string.

Alternatively, the method for disconnecting the tubing hanger running tool from the tubing hanger after the tubing hanger has been installed in the wellhead or the X-mas tree can comprise the steps of:

r) installing a plug from the surface via the work string and landing it in a sealing manner against a seat in the through-going passage of the centre element;
s) pressurising a bore in the plug from the surface via the centre passages in the work string, the transition pipe and the slick-joint respectively;
t) pressurising an annulus in a BOP over the wellhead or the X-mas tree and allowing pressurized fluid to flow through a valve and a channel in the centre element and out into the annulus on the underside of the first ring piston;
u) allowing the first ring piston to be displaced upwards by the pressure while fluid is evacuated from an annulus over the first ring piston so that the lower part of the first ring piston disengages from the locking ring;
v) letting the locking ring contract out of engagement with the locking groove on the inside of the tubing hanger; and
w) pulling the released tubing hanger running tool to the surface by means of the work string.

BRIEF DESCRIPTION OF THE DRAWINGS

In the following, a device and a method for tubing hanger installation in a wellhead or X-mas tree is described, wherein.

DETAILED DESCRIPTION OF THE DRAWINGS

Figure 1:
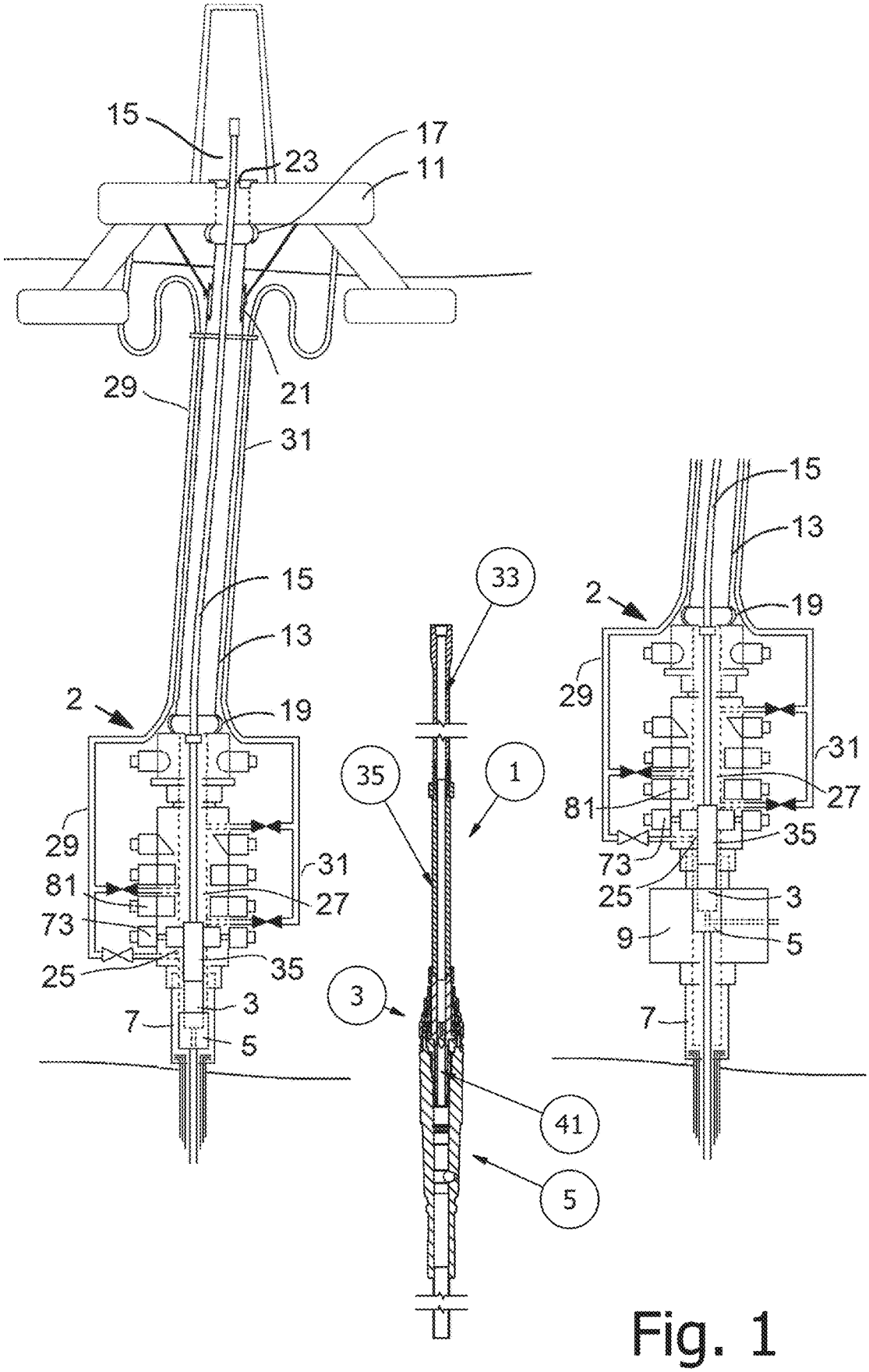
FIG. 1 schematically illustrates a simplified example of a tubing hanger installation in a wellhead or X-mas tree. The figure also shows a simplified landing string with a tubing hanger running tool coupled to a tubing hanger.

In FIG. 1, the reference number 1 indicates a simplified landing string in a BOP 2. The landing string 1 is provided with a tubing hanger running tool 3 and a tubing hanger 5 that is locked in a wellhead 7, alternatively in a horizontal X-mas tree 9 under a BOP 2. The equipment is installed from a floating drilling device 11 through a marine riser 13.

FIG. 1 shows a marine riser 13 as the outermost pipe, exposed to the environment, while the work string 15 is installed inside it. The marine riser 13 is shown skewed to illustrate external loads. It is provided with so-called flex joints 17 and 19 in the upper and lower end respectively. These rotate and/or are bent and will thereby unload the marine riser 13. This causes an umbilical (not shown) to be especially exposed to damage in these areas. Other challenging areas are the marine riser's 13 slip joint 21 and the opening in the drill deck 23 where the umbilical is exposed to wear from movements. One measure to protect the umbilical can be to insert centralising clamps (not shown). These are however exposed to clamping loads that can risk damaging them in such a way that parts can come loose and fall down into the inside of the BOP 2. Loose parts from broken centralising clamps or normal umbilical clamps (not shown) must in this case be "fished out" using time-consuming methods and specialised equipment. Such specialised equipment can form part of a so-called wireline operation. This leads to expensive delays in the operations. It is therefore preferable to introduce a new solution and method for installing production tubing and an associated tubing hanger that eliminates the umbilical and a control module (not shown) on the inside of the marine riser 13.

The present solution is based on hydraulic energy for operating the tool functions being supplied through pressurisation of a lower, closed-off annulus 25 and an upper, closed-off annulus 27 in the BOP 2 via a choke line 29 or kill line 31 to the surface. The annuli 25, 27 are formed by the BOP's pipe rams closing about parts of the landing string 1. Hydraulic pistons that are integrated with a tubing hanger running tool 3 are exposed to confined pressure in the annuli 25, 27 and are arranged to actuate certain function for the tubing hanger running tool/tubing hanger, while other functions are activated mechanically by rotation of the work string 15 from the surface.

FIG. 1 also shows the simplified landing string 1 with a transition pipe 33 to the work string 15, a slick-joint 35 about which the BOP 2 can clamp in a sealing manner, a tubing hanger running tool 3 and a tubing hanger 5.

The tubing hanger running tool 3 is built up of different ring pistons and an upper housing 37 and a lower housing 39 that surround a centre element 41. This is shown in FIGS. 2-8.

Figure 2:
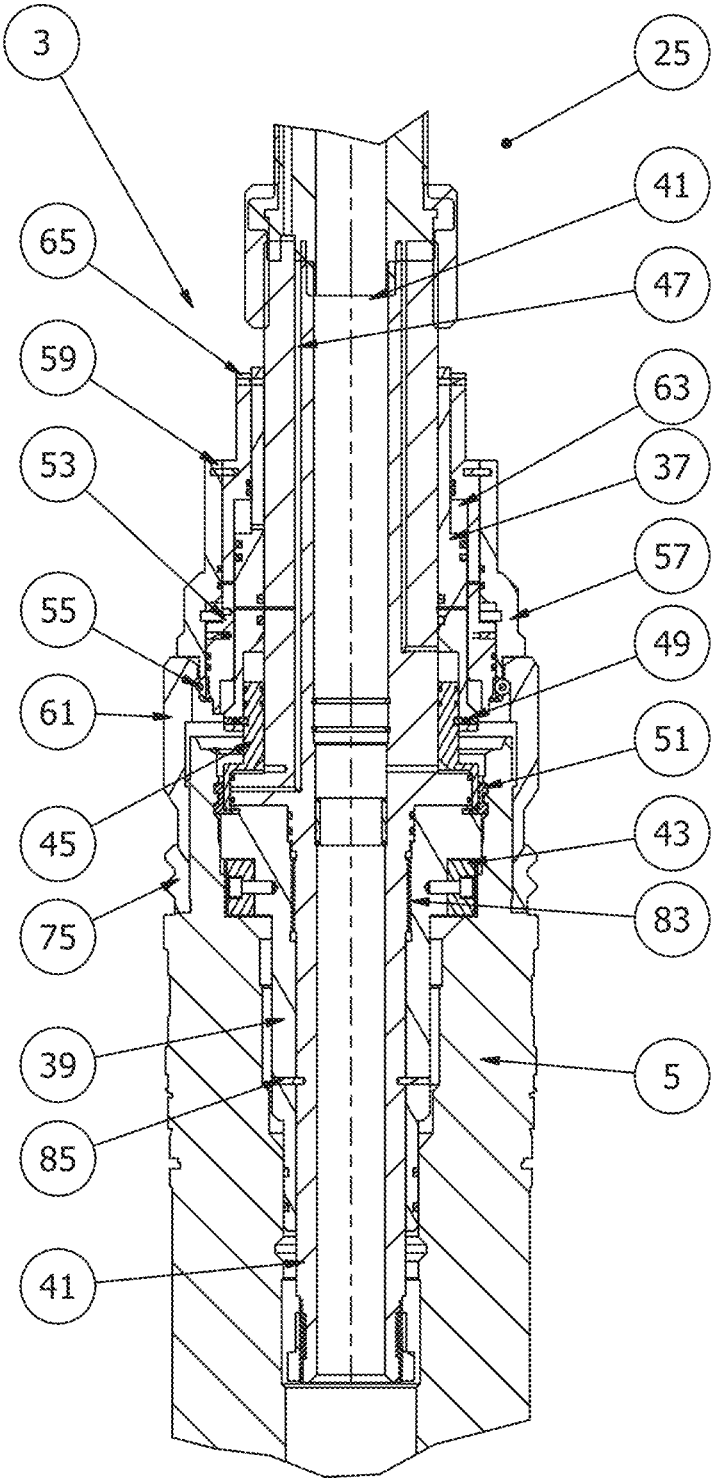
FIG. 2 shows a tubing hanger running tool with two locking pistons for locking a tubing hanger, ready for installation of a tubing hanger. Locking balls grip under a lip on the locking sleeve of the tubing hanger.

FIG. 2 shows the tubing hanger running tool 3 coupled to the tubing hanger 5 on the surface before the equipment is installed in a wellhead 7 or X-mas tree 9 using the work string 15 through the marine riser 13.

Coupling of the tubing hanger running tool 3 and the tubing hanger 5 is done by the lower part of the centre element 41 with the lower housing 39 being inserted into the tubing hanger 5 with anti-rotation elements 43 oriented relative to corresponding locking grooves in the tubing hanger 5. When the tubing hanger running tool 3 reaches an end stop in the tubing hanger 5, a first ring piston 45 is actuated hydraulically via a first bore 47 that runs axially through the upper part of the centre element 41. A number of spring-loaded locking pins 49 jump into an external groove on the first ring piston 45 when it has been displaced to its end position, and concurrently the lower part of the first ring piston 45 pushes the locking ring 51 out into engagement with a corresponding locking groove on the inside of the tubing hanger 5. Thereafter, a second ring piston 53 is pushed towards the tubing hanger 5. The front end of the second ring piston 53 pushes a number of locking balls 55 partially out through corresponding holes in a third, outer ring piston 57 on the tubing hanger running tool 3. The balls 55 engage with the underside of an inner lip 62 on the upper locking sleeve 61 of the tubing hanger 5. When the second ring piston 53 is displaced to its end position, a number of spring-loaded locking pins 59 jump into corresponding, recessed holes on the back end of the third, outer ring piston 57 and lock the second and third ring piston 53, 57 together.

Thereafter, a second bore (not shown) that runs axially through the upper part of the centre element 41 is pressurized. The bore is in connection with an annulus 63 between the second ring piston 53 and the upper housing 37. Pressurising the annulus 63 leads to the ring pistons 53, 57 being pushed somewhat back and pulling with them a locking sleeve 61 for the tubing hanger 5 until the locking sleeve 61 meets an end stop. A number of locking pins 65 is thereafter mounted through bores from the outside of the second ring piston 53 and into corresponding, recessed holes in the upper housing 37, so that the second and the third ring piston 53, 57 and the locking sleeve 61 of the tubing hanger 5 are locked in the upper position.

Figure 3:
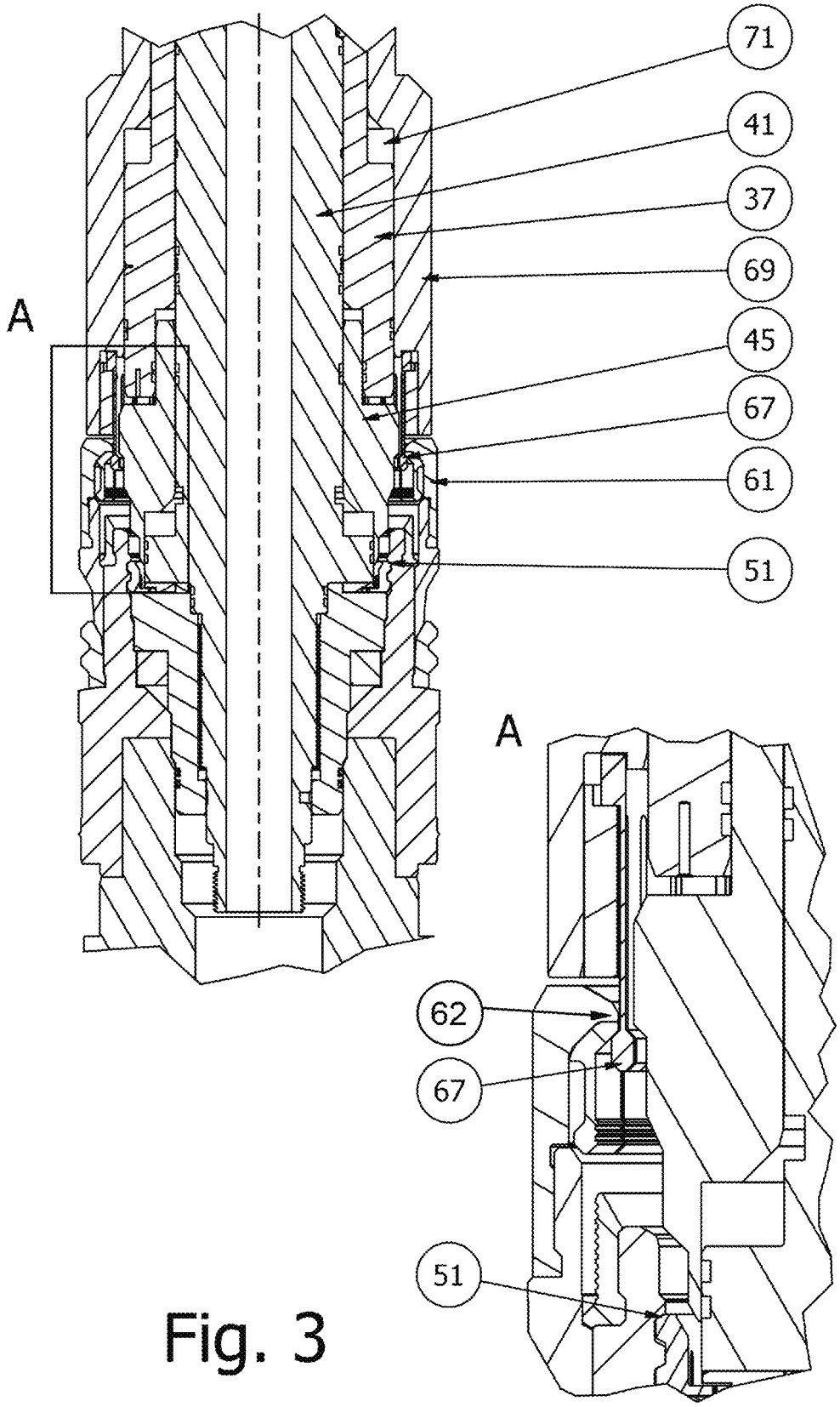
FIG. 3 shows an alternative embodiment with gripping fingers instead of balls and with one locking piston.

FIG. 3 shows an alternative embodiment where the balls 55 are replaced with gripping fingers 67. As in FIG. 2, the alternative first ring piston 45 is actuated hydraulically and pushes in its end position the locking ring 51 out into engagement with a corresponding locking groove on the inside of the tubing hanger 5. One difference from the embodiment in FIG. 2 is that there is a fourth ring piston 69 surrounding the upper housing 37. Attached to the fourth ring piston 69 is a collar of gripping fingers 67 that engage with the underside of an inner lip on the locking sleeve 61 of the tubing hanger 5 as an exterior profile on the ring piston 45 pushes these out to the side during hydraulic actuation for locking the tubing hanger running tool 3 to the tubing hanger 5. Pressurising the annulus 71 between the upper housing 37 and the fourth ring piston 69 leads to the fourth ring piston 69 being pulled somewhat back and pulling with it the locking sleeve 61 of the tubing hanger 5 until it stops. A number of locking pins 65 is thereafter mounted through bores from the outside of the fourth ring piston 69 and into corresponding, recessed holes in the upper housing 37, so that the fourth ring piston 69 and the locking sleeve 61 of the tubing hanger 5 are locked in the upper position the same way as shown in FIG. 2.

Reference is made to FIGS. 1 and 2. The simplified landing string 1 with the mounted tubing hanger 5 is installed from a drilling vessel 11 through the marine riser 13 and the BOP 2. The tubing hanger 5 is oriented and landed in the wellhead 7 or in the X-mas tree 9. A lower BOP pipe ram 73 is closed about the slick-joint 35 on the top side of the tubing hanger running tool 3 and forms a closed, lower annulus 25 that is pressurized from the surface via the choke line 29. The pressure in the annulus 25 acts on the piston areas on the ring pistons 45, 53, 57, 69, which are released to carry out their functions by locking pins being sheared off due to the shearing forces that arise.

Figure 4:
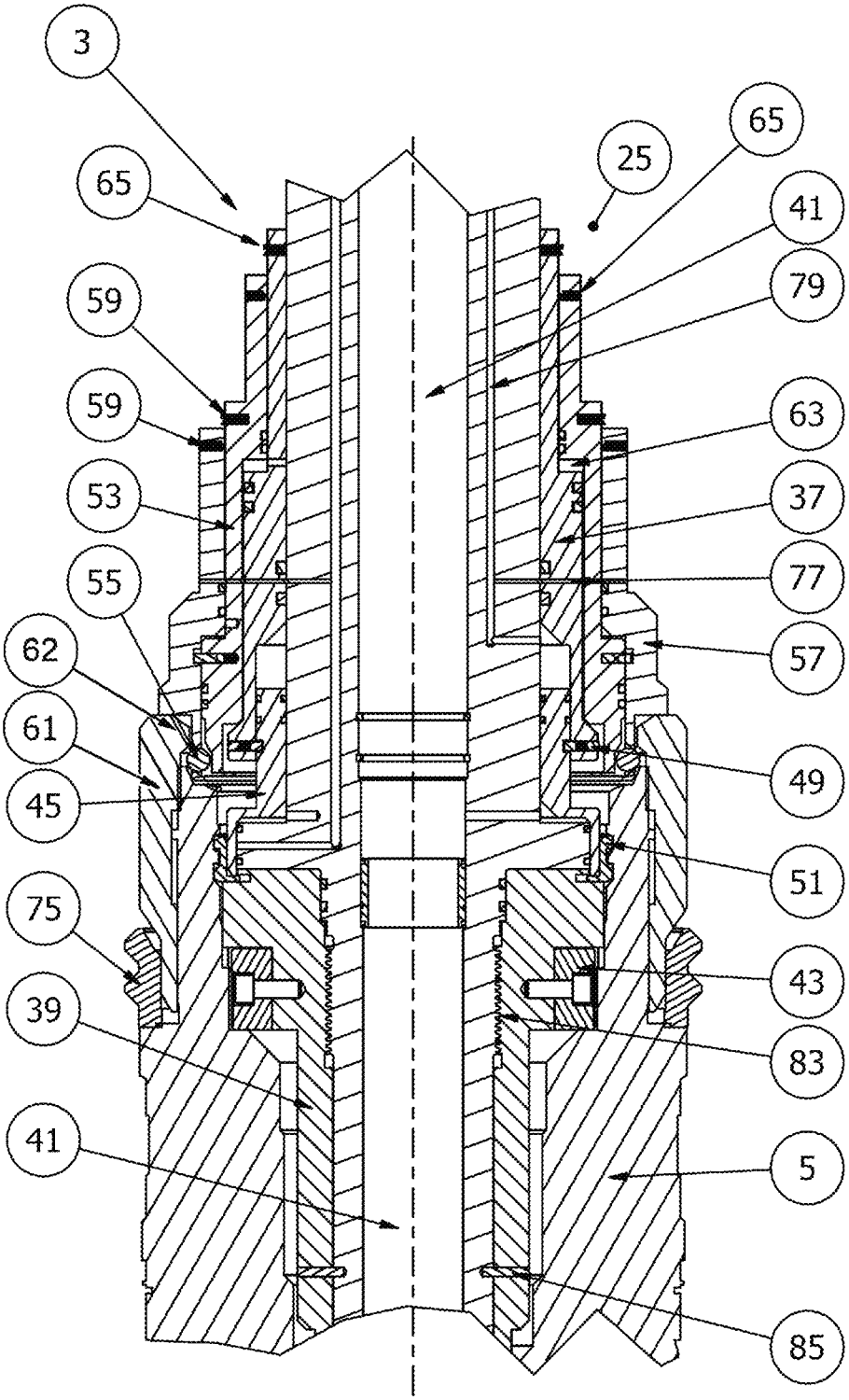
FIG. 4 shows a tubing hanger after it has been locked to a wellhead or X-mas tree (not shown).

Reference is made to FIG. 4, which shows an embodiment where the tubing hanger 5 is locked in the wellhead 7 or the X-mas tree 9 in two steps. First the spring-loaded locking pins 59 are sheared off as the third, outer ring piston 57 is pushed down by the pressure in the annulus 25 and brings with it the locking sleeve 61 of the tubing hanger 5, which pushes a set of locking segments 75 radially out towards a corresponding locking groove in the wellhead 7 or the X-mas tree 9. In the next step, the pressure in the annulus 25 is increased so that the locking pins 65 between the second ring piston 53 and the upper housing 37 are also sheared off. The second and the third ring piston 53, 57 are thereby pushed down and drive the lower part of the locking sleeve 61 of the tubing hanger 5 in between the upper part of the tubing hanger 5 and the locking segments 75.

Figure 5:
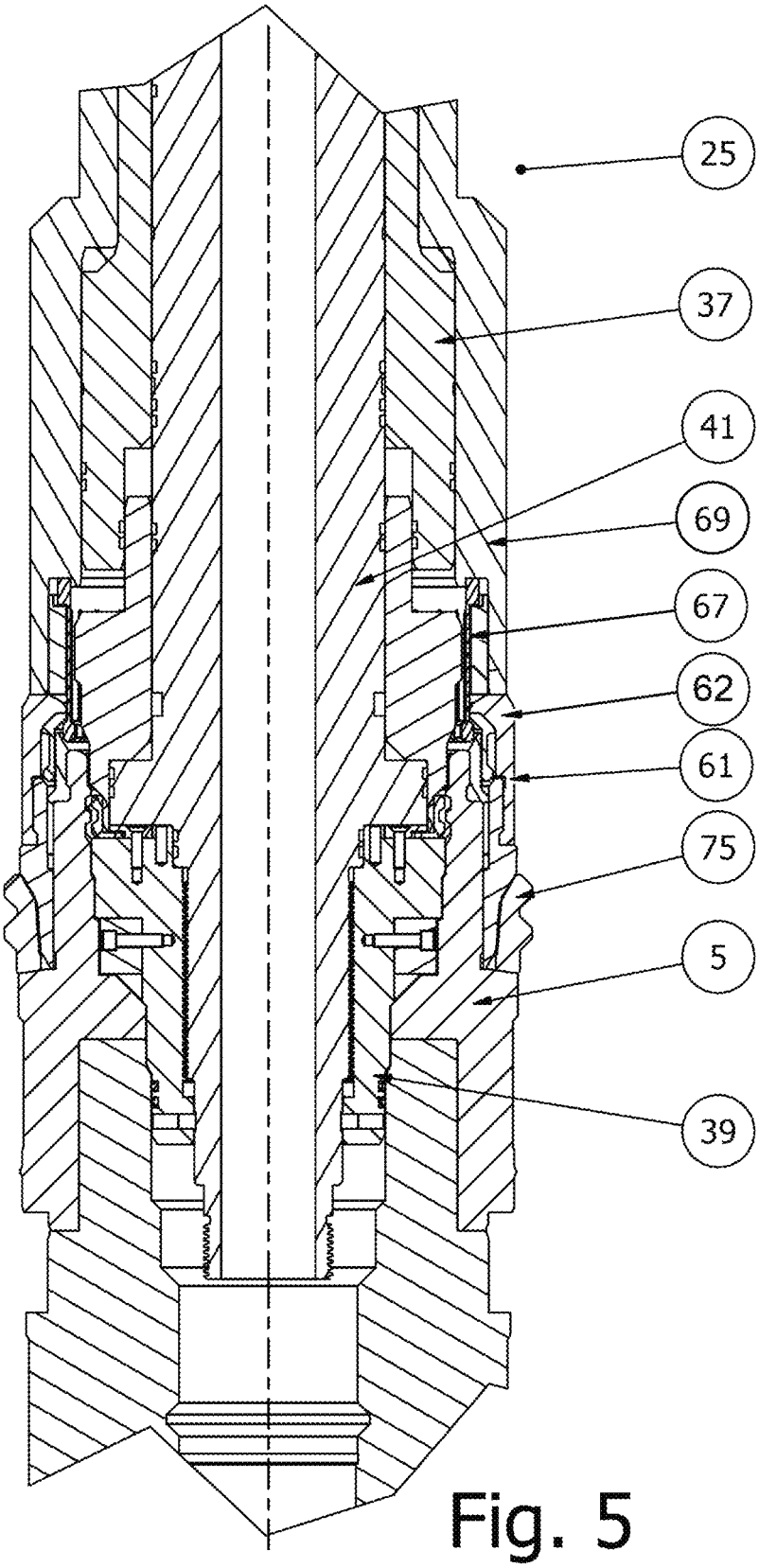
FIG. 5 shows an alternative embodiment with gripping fingers instead of balls, after the tubing hanger has been locked.

As shown in FIG. 5, the tubing hanger 5 can alternatively be locked in one step.

The locking pins (not shown) are sheared off and the fourth ring piston 69 is pushed down by the pressure in the annulus 25 and brings with it the locking sleeve 61 of the tubing hanger 5, which pushes the locking segments 75 of the tubing hanger 5 radially out towards a corresponding locking profile in the wellhead 7 or the X-mas tree 9, as the lower part of the locking sleeve 61 of the tubing hanger 5 is wedged in between the upper part of the tubing hanger 5 and the locking segments 75. The gripping fingers 67 follow the fourth ring piston 69 and are pushed past the exterior profile of the first ring piston 45, which has held the gripping fingers 67 radially outstretched. The gripping fingers 67 thereby spring back to their initial position with clearance to the locking sleeve 61 of the tubing hanger 5.

The tubing hanger 5 is thereby locked to internal locking grooves in the wellhead 7 or the X-mas tree 9.

Figure 6:
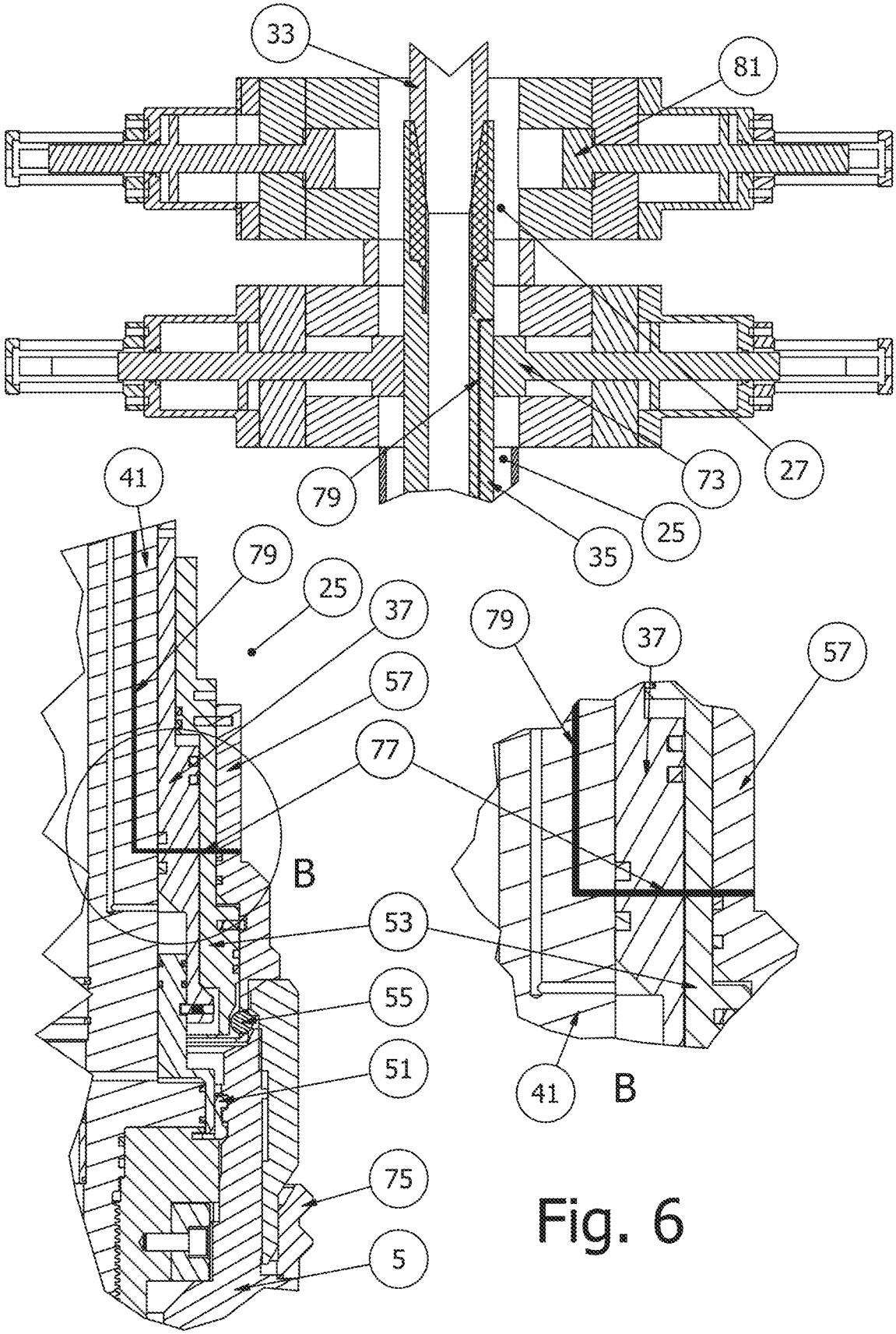
FIG. 6 shows details for verifying that the tubing hanger is locked to a wellhead or X-mas tree.

As shown in FIGS. 4 and 6, the tubing hanger running tool 3 is provided with radial bores 77 through the second and the third ring piston 53, 57, the upper housing 37 and the centre element 41 for verifying locking of the tubing hanger 5. A corresponding bore will be included for the alternative, fourth ring piston 69 (not shown). The radial bores 77 are aligned when the tubing hanger 5 is locked and communicates with an axial bore 79 in the centre element 41, which is connected to a new, axial bore through the slick-joint 35 that ends in the upper annulus 27 in the BOP, over the lower BOP pipe ram 73 that seals around the slick-joint 35.

Completion fluid will then flow through the bores 77, 79 from the lower annulus 25 to the upper annulus 27 as a valve or seal (not shown) in the axial bore 79 opens. This causes a pressure drop in the lower annulus 25 that is registered on the surface via the choke line 29 and indicates that the tubing hanger 5 is locked.

After the tubing hanger 5 has been locked in the wellhead 7 or the X-mas tree 9, the lower BOP pipe ram 73 is opened as the first step in pressure testing the tubing hanger 5 from above. A second pipe ram 81 is then closed sealingly about the transition pipe 33 of the landing string 1 to the work string 15. The annulus in the BOP under an upper pipe ram 81 is then pressurized via the choke line 29. A stable pressure, verified on the surface, indicates that the seal is working.

Reference is made to FIGS. 2 and 4. The centre element 41 is screwed into a threaded portion 83 in the lower housing 39. Anti-rotation elements 43 in the lower housing 39 are in rotation-preventing engagement with recesses in the tubing hanger 5.

Figure 7:
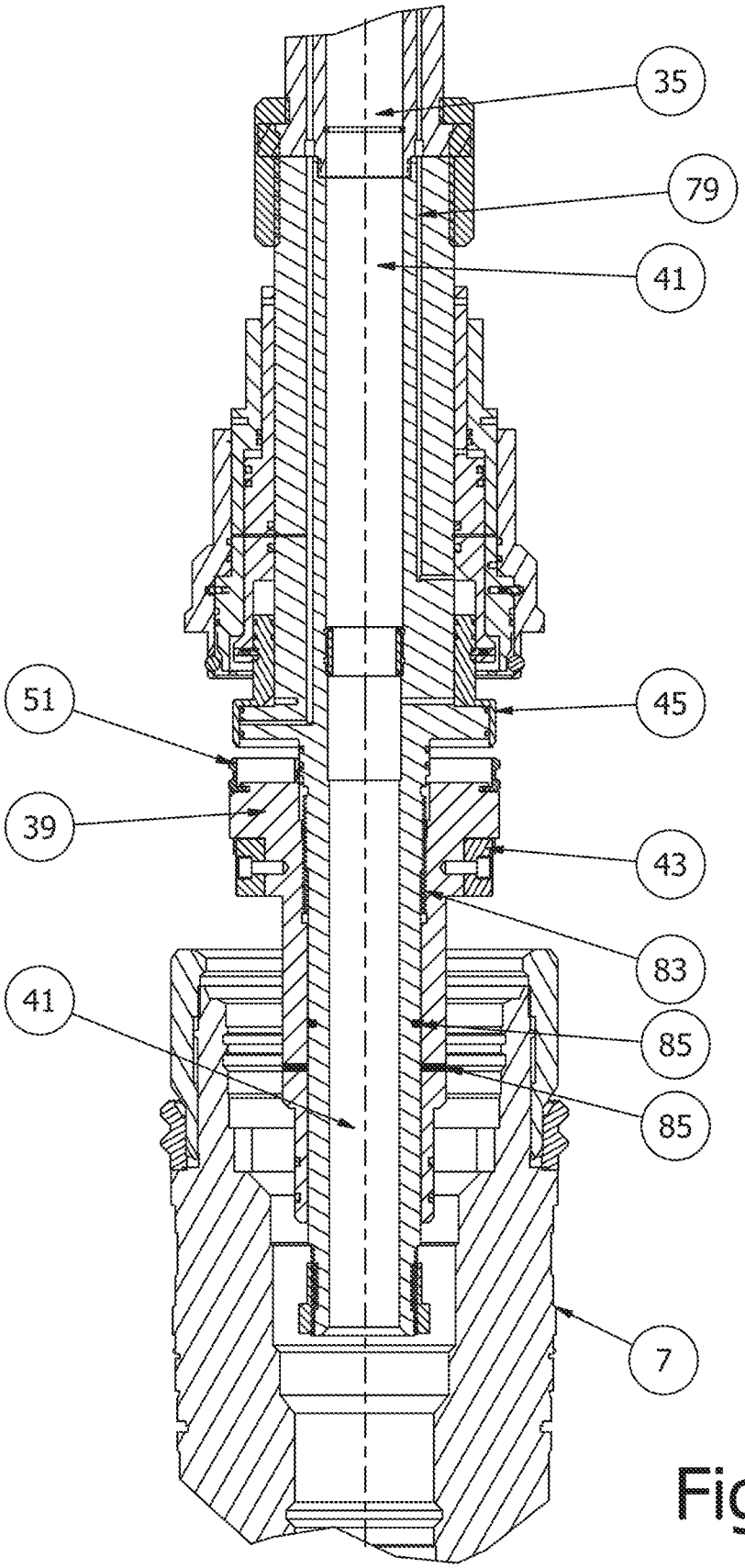
FIG. 7 illustrates a method based on mechanical release of a tubing hanger running tool from a locked tubing hanger.

The primary method for releasing the tubing hanger running tool 3 from the tubing hanger 5 is to twist the work string 15 to the right so that a set of locking pins 85, which attach the centre element 41 to the lower housing 39, are sheared off and allow for the centre element 41 to be screwed upwards in the threaded portion 83 in the lower housing 39. The devices on the upper part of the tubing hanger running tool 3 rotate with the centre element 41. The first ring piston 45, which keeps the locking ring 51 stretched out and in engagement with locking grooves on the inside of the tubing hanger 5, is screwed upwards until it clears the locking ring 51, which then springs back and disengages from the locking grooves in the tubing hanger 5. The locking ring 51 stays on top of the lower housing 39. Thereby the tubing hanger running tool 3 can be pulled out of the tubing hanger 5 and up to the surface, as illustrated in FIG. 7.

Figure 8A:
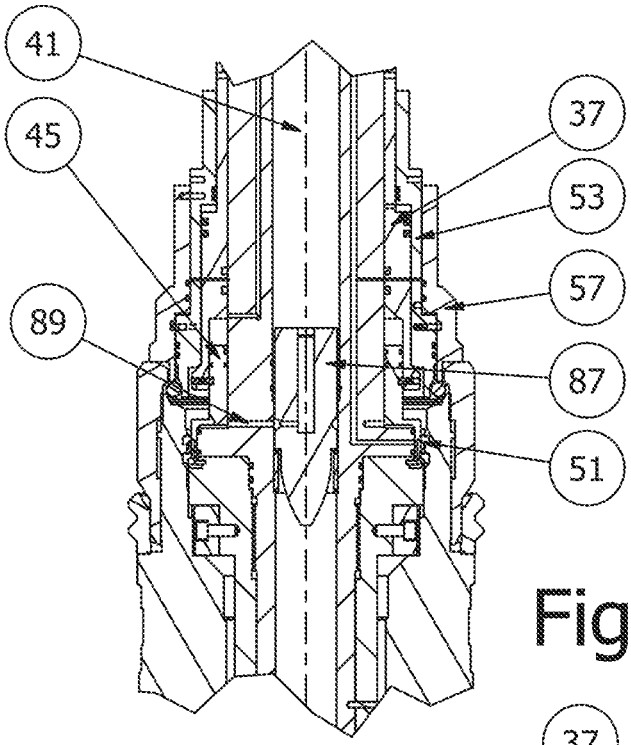
FIGS. 8A-8B illustrate an alternative method with hydraulic release of a tubing hanger running tool from a tubing hanger.

FIG. 8A illustrates an alternative method for releasing the tubing hanger running tool 3 from the tubing hanger 5. The example shows the solution using locking balls 55 and two ring pistons 53, 57. A plug 87 is installed in the tubing hanger running tool 3 from the surface via the bore in the work string 15 and the simplified landing string 1. After the plug 87 has been landed against a seat in the passage of the centre element 41, it is pressurized from the surface via the bore in the work string 15. The pressure is distributed through a channel in the plug 87 that communicates with a radial channel 89 in the centre element 41 so that an area under the ring piston 45 is pressurized. The first ring piston 45 displaces the second and the third ring piston 53, 57 up along the upper housing 37 at the same time as the lower part of the first ring piston 45 is pulled out from the inside of the locking ring 51, which then disengages from the locking grooves in the tubing hanger 5 and stays on top of the lower housing 39. Fluid on the opposite side of the first ring piston 45 is evacuated through a vertical bore in the centre element 41.

Figure 8B:
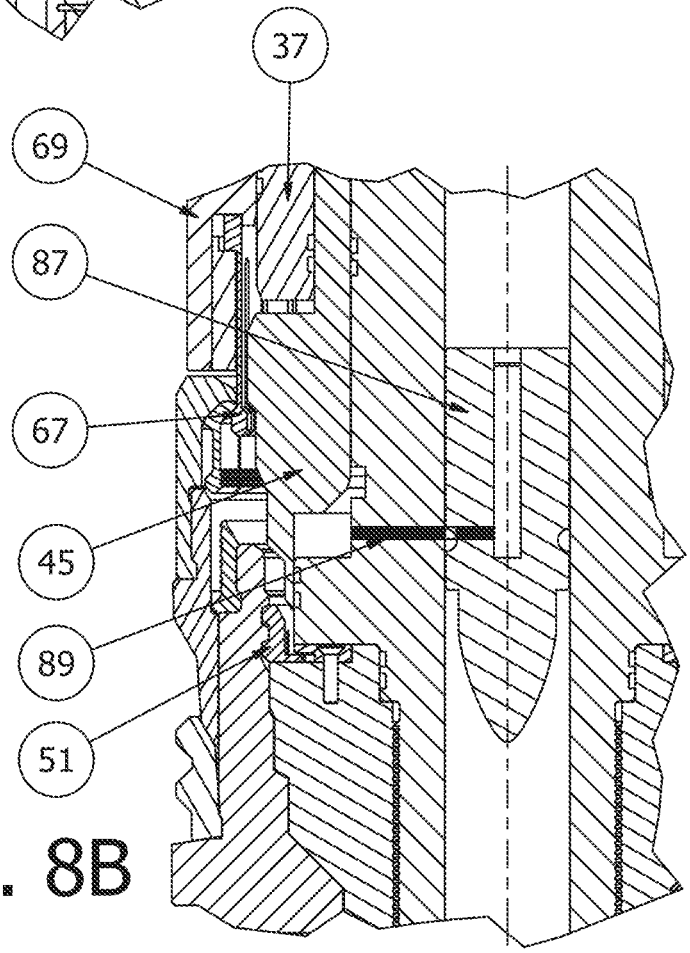

FIG. 8B shows a first embodiment for releasing the tubing hanger running tool 3 from the tubing hanger 5 for the solution using gripping fingers 67, wherein hydraulic pressure, in the same way as described for the example shown in FIG. 8A, is distributed to the underside of the first ring piston 45 via a plug 87 in the passage of the centre element 41. By pressurising the underside of the first ring piston 45 it is driven up along the centre element 41 and the lower part of the first ring piston 45 is pulled out from the inside of the locking ring 51, which then disengages from the locking grooves in the tubing hanger 5. Fluid on the opposite side of the first ring piston 45 is evacuated through a vertical bore in the centre element 41.

Figure 9:
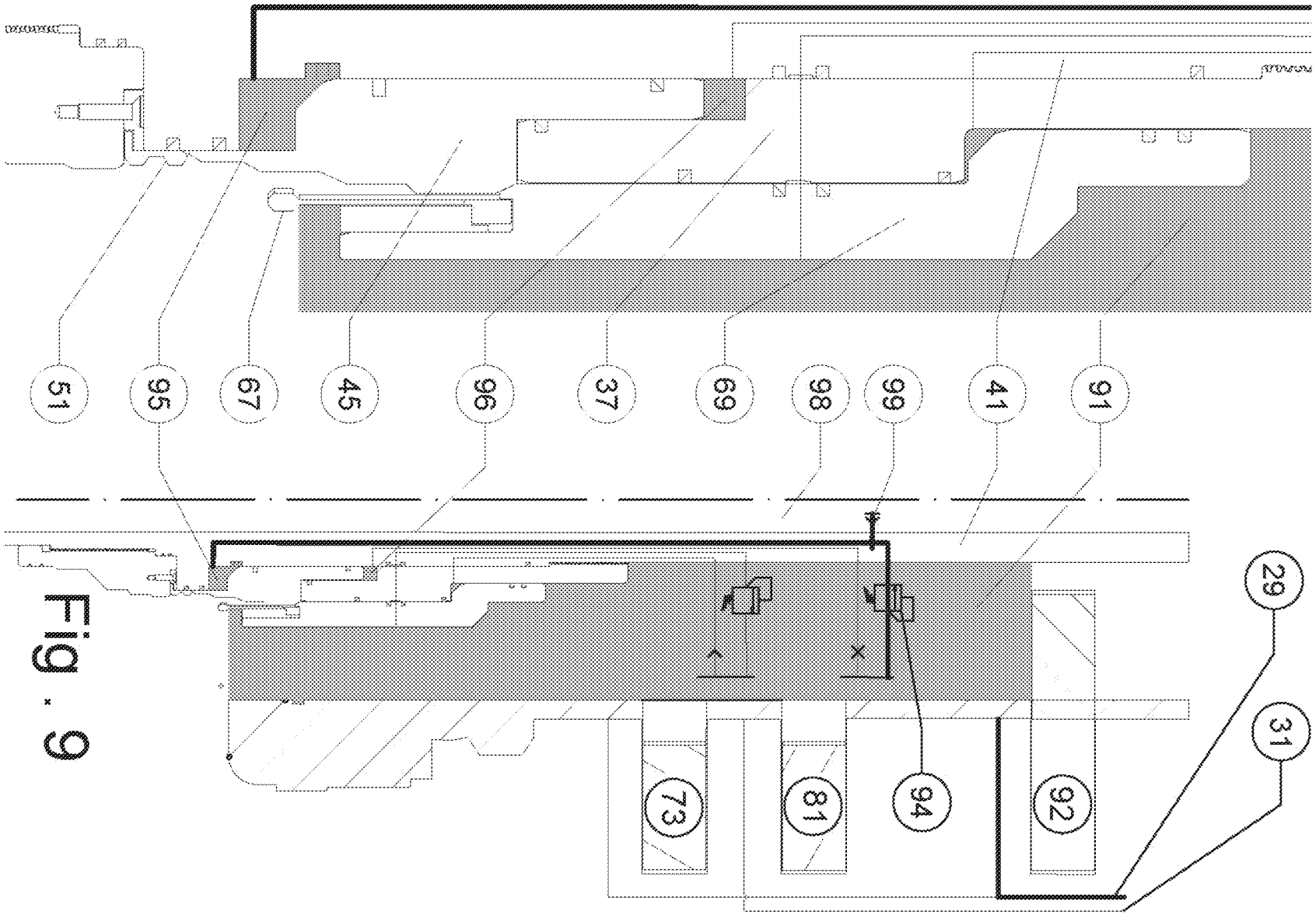
FIG. 9 illustrates an alternative method with hydraulic release of a tubing hanger running tool from a tubing hanger.

FIG. 9 shows a second embodiment for releasing the tubing hanger running tool 3 from the tubing hanger 5 for the solution with gripping fingers 67, wherein the hydraulic pressure is produced in an annulus 91 in the BOP 2 on the underside of an upper pipe ram 92 by pressurising the choke line 29 from the surface. The pressure activates a valve 94 that opens and forms a hydraulic connection from the pressurized annulus 91 via a vertical channel through the centre element 41 to the annulus 95. The pressure on the underside of the first ring piston 45 drives it up along the centre element 41 and the lower part of the first ring piston 45 is pulled out from the inside of the locking ring 51, which then disengages from the locking grooves in the tubing hanger 5. Fluid in an annulus 96 on the top side of the first ring piston 45 is evacuated through a vertical bore in the centre element 41 with an outlet to the centre bore 98 via a check valve 99.

The tubing hanger running tool 3 is thereby released from the tubing hanger 5 and can be hoisted in a stepwise manner to the surface with the work string 15.

Necessary seals are not described, but are known to a skilled person.

The invention claimed is:

1. A tubing hanger running tool arranged for installing a production tubing with a tubing hanger in a subsea wellhead or in a subsea X-mas tree, the tubing hanger running tool comprising:

an upper transition pipe coupled to a work string;

a center slick-joint with a through-going, axial passage as well as channels for hydraulic functions;

a lower center element with a through-going, axial passage as well as channels for hydraulic functions;

several sets of shearable locking pins that by spring-loading or manual displacement are arranged for locking movable parts that surround the lower center element;

an upper housing that surrounds an upper portion of the lower center element and is provided with bores for hydraulic functions;

a lower housing provided with anti-rotation elements and that surrounds a lower portion of the lower center element and is provided with a threaded portion that is engaged with an external threaded portion on the lower center element;

an expandable locking ring arranged for locking the lower center element to an internal groove in the tubing hanger;

a first ring piston that surrounds a center portion of the lower center element and is arranged for stretching out the expandable locking ring;

at least one further ring piston that surrounds the upper housing, the at least one further ring piston being arranged to, when an upper piston area is pressurized with surrounding completion fluid, shear off at least one set of locking pins and axially displace a locking sleeve to an active position; and a set of locking balls or gripping fingers that when radially displaced are arranged to engage with an upper lip internally in the locking sleeve.

2. A method for installing a tubing hanger in a wellhead or X-mas tree using the tubing hanger running tool according to claim 1, wherein the at least one further ring piston comprises a second ring piston, a third ring piston, and a fourth ring piston, and wherein before the tubing hanger is installed in the wellhead or the X-mas tree, the tubing hanger running tool is coupled to the tubing hanger via the following steps:

a) guiding the lower center element with the lower housing into the tubing hanger with the anti-rotation elements in line with allocated locking grooves in the tubing hanger;

b) locking the lower center element to the tubing hanger through hydraulic actuation of the first ring piston, and stretching out the expandable locking ring to radial engagement with the internal groove in the tubing hanger, and letting a first set of spring-loaded locking pins couple the first ring piston to the upper housing;

c) gripping under an internal, upper lip on the locking sleeve of the tubing hanger, either by activating the set of locking balls on an end of the second ring piston and the third ring piston, or activating the set of gripping fingers fastened on a lower edge of the fourth ring piston by letting an external profile on the first ring piston push the gripping fingers radially outwards, to thereby allow the first ring piston to stretch out the expandable locking ring, and allow a further set of spring-loaded locking pins to couple the second ring piston to the third ring piston; and d) securing the locking sleeve of the tubing hanger in an upper position by pressurizing an annulus between the second ring piston and the upper housing or between the fourth ring piston and the upper housing, so that the locking sleeve of the tubing hanger is driven to an upper position where the second ring piston is secured to the upper housing by the set of locking pins.

3. The method according to claim 2, wherein the method comprises these further steps for locking the tubing hanger to the wellhead or the X-mas tree:

e) closing a lower BOP pipe ram about the center slick-joint so that a lower annulus filled with completion fluid is formed in a respective BOP;

f) pressurizing the lower annulus via a choke line and letting the pressure act on the second ring piston, the third ring piston, and the fourth ring piston so that the respective sets of locking pins are sheared off and said second, third, and fourth ring pistons are pushed down towards the locking sleeve of the tubing hanger;

g) letting said first, second, and third ring pistons carry with them the locking sleeve of the tubing hanger; and h) letting a lower part of the locking sleeve of the tubing hanger be wedged in behind locking segments of the tubing hanger so that the locking segments are pushed radially outwards in the allocated locking grooves in the wellhead or the X-mas tree.

4. The method according to claim 3, wherein the method comprises these further steps for verifying locking of the tubing hanger to the wellhead or the X-mas tree:

i) allowing pressurized completion fluid in the annulus to flow in through corresponding, radial bores in the second, third or fourth ring piston, the upper housing and the lower center element and further through an axial bore in the lower center element and the center slick-joint and out into the upper annulus on a top side of the lower BOP pipe ram; and j) registering a pressure drop in the lower annulus from the surface via the choke line.

5. The method according to claim 3, wherein the method comprises these further steps for pressure testing the tubing hanger after it has been installed in the wellhead or the X-mas tree:

k) opening the lower BOP pipe ram;

l) Closing an upper BOP pipe ram in a sealing manner about the upper transition pipe; and m) pressurizing an annulus under the upper BOP pipe ram and verifying a stable pressure.

6. The method according to claim 2, wherein the method comprises the following steps for disconnecting the tubing hanger running tool from the tubing hanger after the tubing hanger has been installed in the wellhead or the X-mas tree:

n) twisting the work string so that the set of locking pins that fasten the lower center element to the lower housing, are sheared off;

o) screwing the lower center element upwards in the threaded portion in the lower housing until a lower part of the first ring piston disengages from the expandable locking ring;

p) allowing the expandable locking ring to contract out of engagement with the allocated locking groove on an inside of the tubing hanger; and q) pulling the released tubing hanger running tool to the surface with the work string.

7. The method according to claim 2, wherein the method comprises the following steps for disconnecting the tubing hanger running tool from the tubing hanger after the tubing hanger has been installed in the wellhead or the X-mas tree:

r) installing a plug from the surface via the work string and landing it in a sealing manner against a seat in the through-going, axial passage of the lower center element;

s) pressurizing a bore in the plug from the surface via center passages in the work string, the upper transition pipe and the center slick-joint respectively;

t) allowing pressurized fluid to flow through a radial channel in the plug, further through a corresponding radial channel in the lower center element and out on an underside of the first ring piston;

u) allowing the first ring piston to be displaced upwards by the pressure while fluid is evacuated from an annulus over the first ring piston so that a lower part of the first ring piston disengages from the expandable locking ring;

v) allowing the expandable locking ring to contract out of engagement with the allocated locking groove on an inside of the tubing hanger; and w) pulling the released tubing hanger running tool to the surface with the work string.

8. The method according to claim 2, wherein the method comprises the following steps for disconnecting the tubing hanger running tool from the tubing hanger after the tubing hanger has been installed in the wellhead or the X-mas tree:

r) installing a plug from the surface via the work string and landing it in a sealing manner against a seat in the through-going, axial passage of the lower center element;

s) pressurizing a bore in the plug from the surface via center passages in the work string, transition pipe and the center slick-joint respectively;

t) pressurizing an annulus in a BOP over the wellhead or the X-mas tree and allowing pressurized fluid to flow through a valve and a channel in the lower center element and out into the annulus on an underside of the first ring piston;

u) allowing the first ring piston to be displaced upwards by the pressure while fluid is evacuated from an annulus over the first ring piston so that a lower part of the first ring piston disengages from the expandable locking ring;

v) allowing the expandable locking ring to contract out of engagement with the allocated locking groove on an inside of the tubing hanger; and w) pulling the released tubing hanger running tool to the surface with the work string.

* * * * *